US009723875B2

(12) United States Patent
Liu

(10) Patent No.: US 9,723,875 B2
(45) Date of Patent: Aug. 8, 2017

(54) ELECTRONIC CIGARETTE AND ASSEMBLY METHOD THEREOF

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 799 days.

(21) Appl. No.: 14/098,011

(22) Filed: Dec. 5, 2013

(65) Prior Publication Data

US 2015/0101622 A1 Apr. 16, 2015

(30) Foreign Application Priority Data

Oct. 15, 2013 (CN) ..... 2013 2 0637206 U

(51) Int. Cl.
*A24F 47/00* (2006.01)
*H05B 1/02* (2006.01)
*H05B 3/40* (2006.01)

(52) U.S. Cl.
CPC ..... *A24F 47/008* (2013.01); *H05B 1/0244* (2013.01); *H05B 3/40* (2013.01)

(58) Field of Classification Search
CPC ..... A24F 47/008; A24F 47/00; A61M 15/06; H05B 3/40; H05B 1/0244
See application file for complete search history.

(56) References Cited

U.S. PATENT DOCUMENTS

2011/0304282 A1* 12/2011 Li ..... A24F 47/008 315/362
2013/0152954 A1* 6/2013 Youn ..... A61M 15/06 131/273
2013/0192615 A1* 8/2013 Tucker ..... H01C 17/00 131/328
2013/0276798 A1* 10/2013 Hon ..... A24F 47/008 131/273
2014/0190503 A1* 7/2014 Li ..... A61M 15/06 131/329
2014/0334803 A1* 11/2014 Li ..... H05B 3/03 392/394

(Continued)

FOREIGN PATENT DOCUMENTS

CN 103355745 A * 10/2013 ..... A24F 47/008

*Primary Examiner* — Jerzi H Moreno Hernandez
(74) *Attorney, Agent, or Firm* — Tim Tingkang Xia, Esq.; Locke Lord LLP

(57) ABSTRACT

The present application relates to an electronic cigarette and an assembly method for the electronic cigarette, the electronic cigarette comprises a battery assembly and an atomizer assembly, the battery assembly includes a battery holder and a battery which is removably contained in the battery holder; the battery includes a first electrode and a second electrode, the battery holder is inserted into the atomizer assembly, and the battery assembly is removably connected to the atomizer assembly; one end of the battery holder is provided with an electrical connector, the electrical connector is respectively electrically connected to the second electrode and the atomizer assembly, and the first electrode is abutted against the atomizer assembly and is electrically connected to the atomizer assembly.

11 Claims, 4 Drawing Sheets

(56) References Cited

U.S. PATENT DOCUMENTS

2014/0334804 A1* 11/2014 Choi ..... A61M 15/06
392/404
2014/0366895 A1* 12/2014 Li ..... H01M 2/1055
131/329

* cited by examiner

ELECTRONIC CIGARETTE AND ASSEMBLY METHOD THEREOF

CROSS-REFERENCE TO RELATED APPLICATIONS

This non-provisional application claims priority under 35 U.S.C. §119(a) on Patent Application No. 201320637206.6, filed in P.R. China on Oct. 15, 2013, the entire contents of which are hereby incorporated by reference.

TECHNICAL FIELD

The present application relates to the technical field of daily electronic products, and more particularly, relates to an electronic cigarette and an assembly method thereof.

BACKGROUND

In the prior art, an electronic cigarette comprises a battery assembly and an atomizer assembly. The battery assembly includes a battery, but the battery can not be removed, when the battery is damaged, the electronic cigarette can not be used, which causes a great waste.

BRIEF SUMMARY

The objective of the present application is to provide an improved electronic cigarette, aiming at the drawbacks in the prior art.

In accordance with one aspect of the present application, there is provided an electronic cigarette, which comprises a battery assembly and an atomizer assembly, wherein the battery assembly includes a battery holder and a battery which is removably contained in the battery holder; the battery includes a first electrode and a second electrode, the battery holder is inserted into the atomizer assembly, and the battery assembly is removably connected to the atomizer assembly; one end of the battery holder within the atomizer is provided with an electrical connector, the electrical connector is respectively electrically connected to the second electrode and the atomizer assembly, and the first electrode is abutted against the atomizer assembly and is electrically connected to the atomizer assembly.

In one embodiment, the battery holder is in the shape of a circular tube, and the battery holder is provided with an accommodating cavity and an opening portion; the accommodating cavity is configured for mounting the battery, and the opening portion is positioned on one end of the accommodating cavity and is configured for the taking out or mounting the battery; the electrical connector is deposited on the opening portion. The electrical connector includes an annular abutting portion which is configured for the electrical connection to the atomizer assembly, and the annular abutting portion is fastened to an end face of the opening portion. The atomizer assembly includes a heating wire, a first elastic electrode column and a second elastic electrode column; the first elastic electrode column and the second elastic electrode column are respectively electrically connected to the both ends of the heating wire; and the first elastic electrode column and the second elastic electrode column extend along the direction toward the battery holder; when the battery holder is inserted into the atomizer assembly, the first elastic electrode column is elastically abutted against the first electrode, and the second elastic electrode column is elastically abutted against the annular abutting portion.

In this embodiment, the battery assembly further includes an end cover which is fastened on one end of the battery holder, the end cover includes a base plate and a second connection portion; the second connection portion is perpendicular to the base plate, and is configured to be connected to one end of the atomizer assembly. The atomizer further includes an atomization sleeve, the second connection portion is in the shape of a tube; a gap is formed between the inner wall of the second connection portion and an exterior sidewall of the battery holder, and the gap is configured for one end of the atomizer assembly to be inserted into. And the end of the atomization sleeve is threaded connected to the inner wall of the second connection portion. The battery assembly further includes a controller and a sound production element which is configured to simulate the sound of water; the controller is respectively electrically connected to the battery, the sound production element and the atomizer assembly, so that the controller controls the battery to supply power to the atomizer assembly and controls the sound production element to produce sound.

Yet in this embodiment, the battery assembly further includes a mounting base which is in the shape of a cylinder; an elastic electrode column is fastened on one end of the mounting base, and a control board is fastened on the other end of the mounting base; a controller is deposited on the control board and is electrically connected to the elastic electrode column; the mounting base is inserted into the battery holder, so that the elastic electrode column is elastically abutted against the second electrode. The battery holder includes a first sleeve and a second sleeve, and the first sleeve is integrated with the second sleeve; the battery is deposited within the first sleeve, and the mounting base is inserted into the second sleeve; a partition plate is deposited at the junction of the first sleeve and the second sleeve, and a through-hole which is configured for the elastic electrode column to pass through is defined on the partition plate. And the battery assembly further includes a third sleeve which is configured to grip and fasten the electrical connector, the third sleeve is sleeved on an exterior sidewall of the first sleeve and is coplanar with an exterior sidewall of the second sleeve in circumference direction. The sidewall of the second connection portion is provided with a charging interface which is configured for charging electrodes of the external charger to be inserted into. And the atomizer assembly further includes an atomization sleeve, the atomization sleeve and the second connection portion are made from conductive metal and are electrically connected to each other; the first elastic electrode column is electrically connected to the atomization sleeve; a first charging electrode socket and a second charging electrode socket are deposited within the charging interface, the first charging electrode socket is electrically connected to the second connection portion, and the second charging electrode socket is electrically connected to the controller on the control board.

In another embodiment, advantageously, the electrical connector further includes an annular first connection portion; the annular first connection portion is perpendicularly formed on the circumference of the inner ring of the annular abutting portion, and is inserted onto an inner wall of the opening portion.

In according with another aspect of the present application, there is provided an assembly method for an electronic cigarette, wherein includes the following steps:

S1: mounting a battery in a first sleeve of a battery holder, and mounting an electrical connector onto an opening portion of the battery holder, and electrically connecting the electrical connector to a second electrode of the battery;

S2: mounting a control board onto one end of a mounting base, and electrically connecting a controller on the control board to an elastic electrode column on the other end of the mounting base;

S3: inserting one end of the mounting base that is provided with the elastic electrode column into a second sleeve of the battery holder, and the elastic electrode column passes through a through-hole on a partition plate and is elastically abutted against the second electrode of the battery;

S4: fastening an end cover on one end of the battery holder, the end is far away from an atomizer assembly, making the control board contained within the end cover;

S5: inserting one end of the battery holder, the end is far away from the end cover, into an atomization sleeve of the atomize assembly, and rotating the atomization sleeve so that one end of the atomization sleeve is threaded connected to an inner wall of a second connection portion of the end cover; a first electrode of the battery is elastically abutted against a first elastic electrode column of the atomizer assembly, and an annular abutting portion of the electrical connector is elastically abutted against a second elastic electrode column of the atomizer assembly.

When implementing the electronic cigarette of the present application, the following advantageous can be achieved: the battery assembly of the electronic cigarette according to the present application can be removable relative to the atomizer assembly. When the battery is damaged or the power is running out, the battery assembly can be removed from the atomizer assembly, and the used battery can be taken out from the opening portion of the battery holder, then a new battery can be replaced, and thus the replacement of the battery is more convenient. Then, the battery assembly is removably connected to the atomizer assembly by one end that is far away from the atomizer assembly, and the battery holder is inserted into the atomizer assembly, therefore, no other components will block the sight, easier for the alignment, and the assembly efficiency is high; besides, the entire construction of the electronic cigarette is simple and compact, and the appearance is more concise. Finally, since the battery assembly is directly electrically connected to the atomizer assembly through the electrical connector on the battery holder and through the second electrode of the battery, thereby there will not need any wire for the connection between the battery assembly and the atomizer assembly, so that not only the electrical connection is reliable, but also the inconvenience caused by the wire during the assembling and the using process can be avoided.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

In order to make the technical features, the propose and the technical effect of the present application more clearly, the present application will now be described in detail with reference to the accompanying drawings and embodiments.

Figure 1:
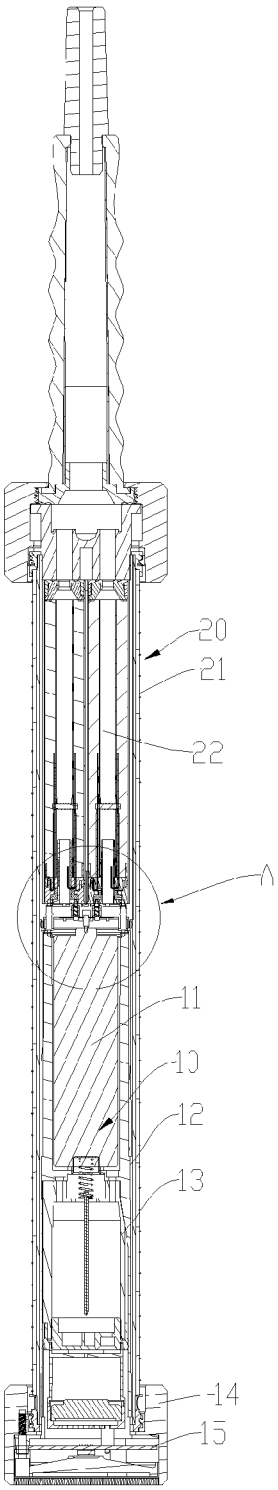
FIG. 1 illustrates a cutaway view of an electronic cigarette according to an embodiment of the present application.

FIG. 1 shows an electronic cigarette according to an embodiment of the present application. The electronic cigarette comprises a battery assembly 10 and an atomizer assembly 20. The battery assembly 10 is removably connected to the atomizer assembly 20. The battery assembly 10 is configured to supply power to the atomizer 20, and the atomizer assembly 20 is configured to store tobacco extract tar, to heat and atomize the tobacco extract tar into smoke for smokers to suck in, so as to achieve the effect of the simulating smoking.

Figure 2:
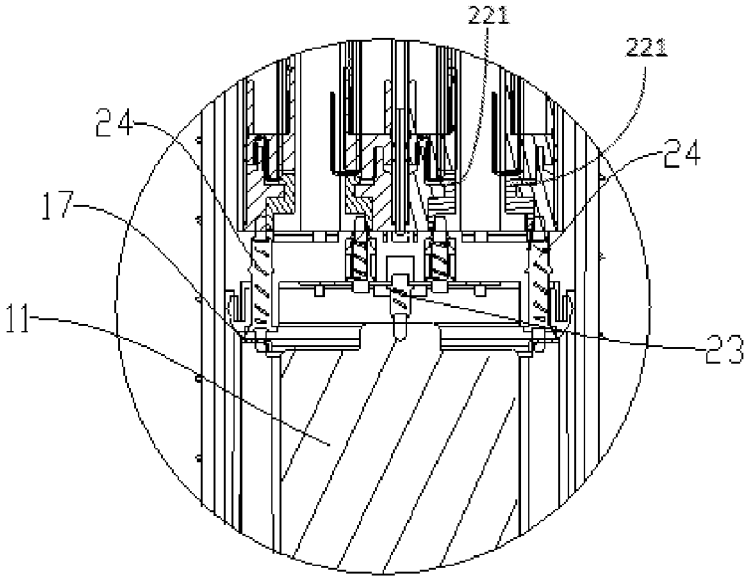
FIG. 2 illustrates a partial enlarged view of the region A according to the embodiment shown in FIG. 1.
Figure 3:
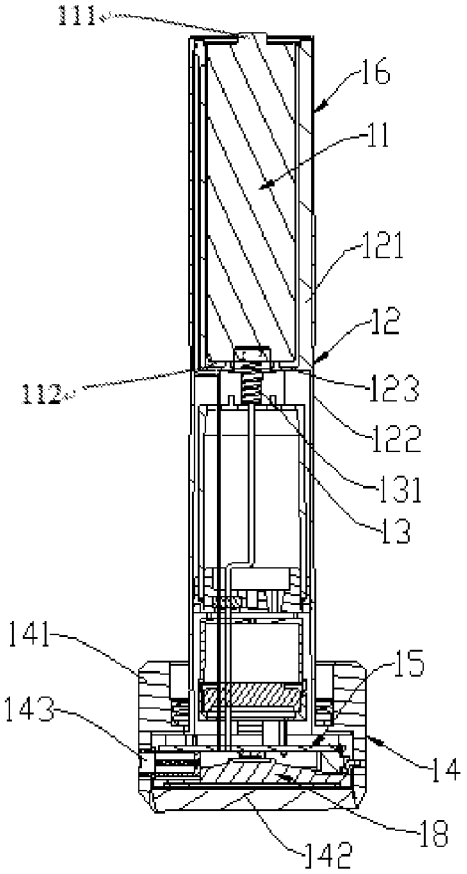
FIG. 3 illustrates a cutaway view of a battery assembly according to the embodiment shown in FIG. 1.

Referring to both FIG. 2 and FIG. 3, the battery assembly 10 includes a battery 11, a battery holder 12, a mounting base 13, an end cover 14, a control board 15, an electrical connector 17 and a sound production element 18. A controller (not shown here) is mounted on the control board 15. The controller is electrically connected to the battery 11, the sound production element 18 and the atomizer assembly 20, so that the controller controls the battery 11 to supply power to the atomizer assembly 20 and controls the sound production element 18 to produce sound.

The sound production element 18 is configured to simulate the sound of water during smoking. The sound production element 18 is deposited in the end cover 14, wherein the sound production element 18 may be a horn. Thereby, the electronic cigarette according to the present embodiment may be called as an electronic water cigarette, which can achieve the effect of simulating real water cigarette without any liquid water. Wherein the battery 11 is contained in the battery holder 12, the battery 11 includes a first electrode 111 and a second electrode 112; the first electrode 111 is positioned on one end of the battery 11, the end is close to the atomizer assembly 20, and the second electrode 112 is positioned on the other end of the battery, the end is away from the atomizer assembly 20. The control board 15 is mounted on the mounting base 13, and the mounting base 13 is inserted into the battery holder 12 from one end of the battery holder 12, the end is away from the atomizer assembly 20. The electrical connector 17 is positioned on one end of the battery holder 12, the end is inserted into the atomizer assembly 20, and the electrical connector 17 is electrically connected to the second electrode 112.

Figure 4:
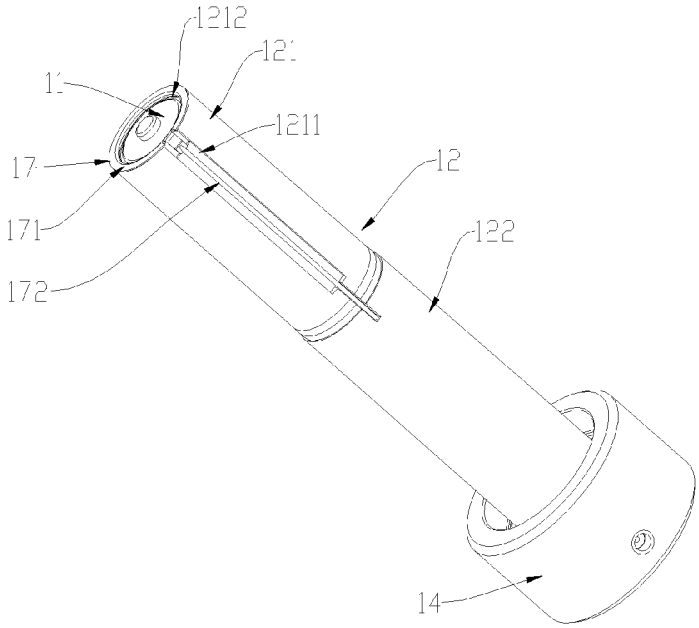
FIG. 4 illustrates a schematic view of the battery assembly according to the embodiment shown in FIG. 1.
Figure 5:
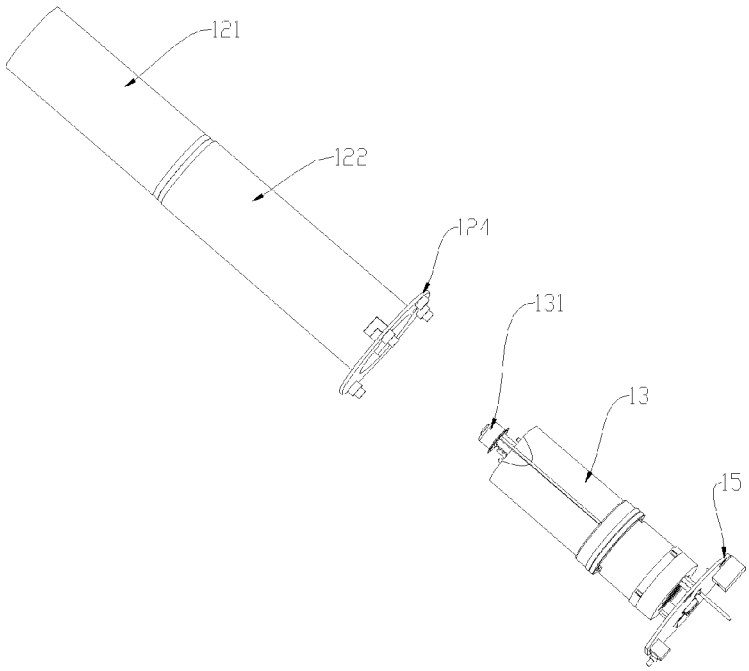
FIG. 5 illustrates a disassembled view of the battery assembly without an end cover according to the embodiment shown in FIG. 1.

As shown in FIG. 3, FIG. 4 and FIG. 5, the battery holder 12 is in the shape of circular tube, including a first sleeve 121 and a second sleeve 122, and the first sleeve 121 is integrated with the second sleeve 122. Wherein, a radius of the first sleeve 121 is less than a radius of the second sleeve 122. A partition plate 123 is deposited at the junction of the first sleeve 121 and the second sleeve 122. The first sleeve 121 includes an accommodating cavity and an opening portion 1212; the accommodating cavity is configured for mounting the battery 11, and the opening portion 1212 is positioned on one end of the accommodating cavity and is configured for taking out or mounting the battery 11. The second sleeve 122 is configured for the mounting base 13 to be inserted into; and a through-hole (not shown here) is defined in the partition plate 123. An annular fixed plate 124 is deposited on one end of the second sleeve 122; the end is away from the first sleeve 121. The fixed plate 124 is configured to fasten the control board 15, and a limiting projection (not labeled here) is formed on one face of the fixed plate 124, the face is toward the end cover. A slot 1211 is axially formed on an exterior sidewall of the battery holder 12. The slot 1211 extends from an end face of the opening portion 1212 of the first sleeve 121 to the second sleeve 122. In another embodiment, the battery holder 12 further includes a third sleeve 16, and the third sleeve 16 is configured to grip and fasten the electrical connector 17. The third sleeve 16 is sleeved on the exterior sidewall of the first sleeve 121 and is coplanar with an exterior sidewall of the second sleeve 122 in circumference direction, as a result of which the entire construction of the battery holder 12 is more concise and more compact.

The mounting base 13 is in the shape of a cylinder, and the control board 15 is mounted on one end of the mounting base 13. The other end of the mounting base 13 is provided with an elastic electrode column 131, and the elastic electrode column 131 is electrically connected to a controller of the control board 15. A limiting hole is defined in the control board corresponding to the limiting projection on the fixed board 124. The elastic electrode column 131 is deposited along a shaft axis of the mounting base 13. When the mounting base 13 is inserted into the second sleeve 122, the elastic electrode column 131 passes through a through-hole on the partition plate 123 and is elastically abutted against the second electrode 112 of the battery 11. The limiting projection on the fixed plate 124 is positioned in the limiting hole on the control board 15 in interference fit, which makes the fixed plate 124 permanently connected to the control board 15. In the present embodiment, the elastic electrode column 131 may be made from elastic conductive material such as conductive rubber; and the elastic electrode column 131 may also be a rigid electrode column combining with a spring.

The end cover 14 includes a circular base plate 142 and a second connection portion 141; the second connection portion 141 is deposited on the base plate 142 and is perpendicular to the base plate 142. The second connection portion 141 is in a shape of circular tube, and is deposited along the circumference of the base plate 142. The control board 15 is contained within the end cover 14, and the fixed plated 124 on the end of the second sleeve 122 is clamped in the end cover 14. Furthermore, a gap is formed between an inner wall of the second connection portion 141 and an exterior sidewall of the second sleeve 122, and the gap is configured for one end of the atomizer assembly 20 to be inserted into. Advantageously, a thread is formed on the inner wall of the second connection portion 141, and the end of the atomizer assembly 20 is threaded connected to the inner wall of the second connection portion 141, so as to achieve the removable connection between the atomizer assembly 20 and the battery assembly 10.

The second connection portion 141 is made from conductive metal, and a sidewall of which is provided with a charging interface 143, the charging interface 143 is configured for charging electrodes of an external charger to be inserted into. A first charging electrode socket and a second charging electrode socket are deposited in the charging interface 143. The first charging electrode socket is electrically connected to the second connection portion 141, and the second charging electrode socket is electrically connected to the controller of the control board 15.

Figure 6:
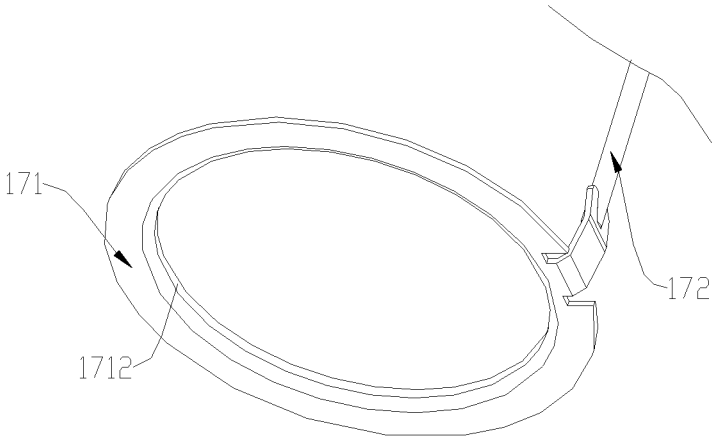
FIG. 6 illustrates a schematic view of an electrical connector according to the embodiment shown in FIG. 1.

As shown in FIG. 4 and FIG. 6, the electrical connector 17 includes an annular abutting portion 171 and an annular first connection portion 1712; the annular first connection portion 1712 is perpendicularly formed on the circumference of inner ring of the annular abutting portion 171. The annular first connection portion 1712 is configured to be inserted into an inner wall of the opening portion 1212, and the annular abutting portion 171 is attached to an end face of the opening portion 1212, so that the electrical connector 17 can be reliably clamped on the opening portion 1212. The electrical connector 17 is electrically connected to the second electrode 112 of the battery 11 through a wire 172 soldered onto the electrical connector 17. The wire 172 is partially contained into the slot 1211 on the battery holder 12. The electrical connector 17 is in the shape of an annulus, so that when the battery holder 12 is inserted into the atomization sleeve 21, the misplacement between the electrical connector 17 and the second elastic electrode column 24 of the atomizer assembly 20 can be avoided, which has advantages of convenient to the assembly and improving the reliability. Furthermore, the third sleeve 16 grips and fastens the electrical connector 17 and the wire 172, and thus not only the electrical connector 17 is fastened steadily, but also the adverse impact of scratching and breaking the wire 172 when assembling, taking out and mounting the battery assembly 10 due to the exposure of the wire 172 is avoided. By designing the opening portion 1212, when the battery 11 is damaged, the battery assembly 10 can be removed from the atomizer assembly 20, and the battery 11 can be taken out from the opening portion 1212.

The atomizer assembly 20 includes an atomizer 22, an atomization sleeve 21, a first elastic electrode column 23 and two second elastic electrode columns 24. The atomizer 22 is configured to atomize the tobacco extract tar which stored therein, and the atomization sleeve 21 is configured to contain the atomizer 22. The number of the atomizer 22 may be one or more. In the present embodiment, there are two atomizers 22. The two atomizers 22 are deposited side by side along the direction parallel to the shaft axis of the atomization sleeve 21. The first elastic electrode column 23 is fixed along the shaft axis of the atomization sleeve 21, and the two second elastic electrode columns 24 are fixed on two sides of the first elastic electrode column 23 symmetrically, and are parallel to the first elastic electrode column 23. In the present embodiment, the first elastic electrode column 23 and the second elastic electrode column 24 may be made from elastic conductive material such as conductive rubber; and they may also be a rigid electrode column combining with a spring.

Each atomizer 22 includes a heating wire 221 which is configured to heat and atomize the tobacco extract tar. One end of each heating wire 221 is electrically connected to one second elastic electrode columns 24, and the other end of each heating wires 221 is electrically connected to the first elastic electrode column 23. The atomization sleeve 21 is made from conductive metal. The first elastic electrode column 23 is electrically connected to the atomization sleeve 21, and the end of the atomization sleeve 21 is provided with external thread. The atomization sleeve 21 is threaded connected to the inner wall of the second connection portion 141 and is electrically connected to the second connection portion 141. The atomizer 22 is the prior art, and is not described in details any more here.

When assembling, the battery holder 12 is inserted into the atomization sleeve 21, two second elastic electrode columns 24 are respectively elastically abutted against to the annular abutting portion 171 of the electrical connector 17, and the first elastic electrode column 23 is elastically abutted against the first electrode 111 of the battery 11. The end of the atomization sleeve 11 is threaded connected to the inside of the end cover 14.

When charging, the external charger, the first charging electrode socket, the second connection portion 141, the atomization sleeve 21, the first elastic electrode column 23, the battery 11, the elastic electrode column 131, the controller, and the second charging electrode socket form a charging circuit, so as to achieve the charging to the battery 11.

The present application also provides an assembling method for an electronic cigarette, including the following steps:

S1: mounting a battery 11 in a first sleeve 121 of a battery holder 12, and mounting an electrical connector 17 onto an opening portion 1212 of the battery holder 12, and electrically connecting the electrical connector 17 to a second electrode 112 of the battery;

S2: mounting a control board 15 onto one end of a mounting base 13, and electrically connecting a controller on the control board 15 to an elastic electrode column 131 on the other end of the mounting base 13;

S3: inserting one end of the mounting base 131 that is provided with the elastic electrode column 131 into a second sleeve 122 of the battery holder 12, and the elastic electrode column 131 passes through a through-hole on a partition plate 123 and is elastically abutted against the second electrode 112 of the battery 11;

S4: fastening an end cover 14 on one end of the battery holder 12 that is far away from an atomizer assembly 20, making the control board 15 contained within the end cover 14;

S5: inserting one end of the battery holder 12 that is far away from the end cover 14 into an atomization sleeve 21 of the atomize assembly 20, and rotating the atomization sleeve 21 so that the end of the atomization sleeve is threaded connected to an inner wall of the second connection portion 141 of the end cover 14; the first electrode of the battery 11 is elastically abutted against a first elastic electrode column 23 of the atomizer assembly 20, and an annular abutting portion 171 of an electrical connector 17 is elastically abutted against a second elastic electrode column 24 of the atomizer assembly 20.

In conclusion, the battery assembly 10 of the electronic cigarette according to the present application can be removable relative to the atomizer assembly 20. When the battery 11 is damaged or the power is running out, the battery assembly 10 can be removed from the atomizer assembly 20, and the used battery can be taken out from the opening portion 1212 of the battery holder 12, then a new battery can be replaced, and thus the replacement of the battery is more convenient. Then, the battery assembly 10 is removably connected to the atomizer assembly 20 by one end that is far away from the atomizer assembly 20, and the battery holder 12 is inserted into the atomizer assembly 20, therefore, no other components will block the sight, easier for the alignment, and the assembly efficiency is high; besides, the entire construction of the electronic cigarette is simple and compact, and the appearance is more concise. Finally, since the battery assembly 10 is directly electrically connected to the atomizer assembly 20 through the electrical connector 17 on the battery holder 12 and through the second electrode 112 of the battery 11, thereby there will not need any wire for the connection between the battery assembly 10 and the atomizer assembly 20, so that not only the electrical connection is reliable, but also the inconvenience caused by the wire during the assembling and the using process can be avoided.

Although the present application is illustrated with the embodiments accompanying the drawings, the present application is not limited to the above-mentioned specific embodiments, and the above-mentioned embodiments are only for illustration, not for limitation. In the inspiration of the present application, those skilled in the art may make many modifications, without going beyond the purpose and the scope the claims intend to protect of the present application; all these belong to the protection of the present application.

What is claimed is:

1. An electronic cigarette comprising a battery assembly and an atomizer assembly, wherein the battery assembly includes a battery holder and a battery which is removably contained in the battery holder; the battery includes a first electrode and a second electrode, one end of the battery holder is inserted into one end of the atomizer assembly, and the battery assembly is removably connected to the atomizer assembly; the one end of the battery holder inserted into the one end of the atomizer assembly is provided with an electrical connector, the electrical connector is respectively electrically connected to the second electrode and the atomizer assembly, and the first electrode is abutted against the atomizer assembly and is electrically connected to the atomizer assembly;

wherein the battery holder is in the shape of a circular tube, and the battery holder is provided with an accommodating cavity and an opening portion; the accommodating cavity is configured for mounting the battery, and the opening portion is positioned on one end of the accommodating cavity and is configured for taking out or mounting the battery; the electrical connector is deposited on the opening portion;

wherein the electrical connector includes an annular abutting portion which is configured for the electrical connection to the atomizer assembly, and the annular abutting portion is fastened to an end face of the opening portion; and wherein the atomizer assembly includes a heating wire, a first elastic electrode column and a second elastic electrode column; the first elastic electrode column and the second elastic electrode column are respectively electrically connected to both ends of the heating wire; and the first elastic electrode column and the second elastic electrode column extend along a direction toward the battery holder;

when the battery holder is inserted into the atomizer assembly, the first elastic electrode column is elastically abutted against the first electrode, and the second elastic electrode column is elastically abutted against the annular abutting portion.

2. The electronic cigarette according to claim 1, wherein the electrical connector further includes an annular first connection portion, the annular first connection portion is perpendicularly formed on the circumference of an inner ring of the annular abutting portion, and is inserted onto an inner wall of the opening portion.

3. The electronic cigarette according to claim 1, wherein the battery assembly further includes an end cover which is fastened on one end of the battery holder, the end cover includes a base plate and a second connection portion; the second connection portion is perpendicular to the base plate, and is configured to be connected to one end of the atomizer assembly.

4. The electronic cigarette according to claim 3, wherein the atomizer further includes an atomization sleeve, the second connection portion is in the shape of a tube; a gap is formed between an inner wall of the second connection portion and an exterior sidewall of the battery holder, and the gap is configured for the end of the atomizer assembly to be inserted into.

5. The electronic cigarette according to claim 4, wherein the end of the atomization sleeve is threaded connected to the inner wall of the second connection portion.

6. The electronic cigarette according to claim 5, wherein the battery assembly further includes a controller and a sound production element which is configured to simulate the sound of water; the controller is respectively electrically connected to the battery, the sound production element and the atomizer assembly, so that the controller controls the battery to supply power to the atomizer assembly and controls the sound production element to produce sound.

7. The electronic cigarette according to claim 6, wherein the battery assembly further includes a mounting base which is in the shape of a cylinder; an elastic electrode column is fastened on one end of the mounting base, and a control board is fastened on the other end of the mounting base; the controller is deposited on the control board and is electrically connected to the elastic electrode column;

the mounting base is inserted into the battery holder, so that the elastic electrode column is elastically abutted against the second electrode.

8. The electronic cigarette according to claim 7, wherein the battery holder includes a first sleeve and a second sleeve, and the first sleeve is integrated with the second sleeve; the battery is deposited within the first sleeve, and the mounting base is inserted into the second sleeve; a partition plate is deposited at the junction of the first sleeve and the second sleeve, and a through-hole which is configured for the elastic electrode column to pass through is defined on the partition plate.

9. The electronic cigarette according to claim 8, wherein the battery assembly further includes a third sleeve which is configured to grip and fasten the electrical connector, the third sleeve is sleeved on an exterior sidewall of the first sleeve and is coplanar with an exterior sidewall of the second sleeve in a longitudinal direction.

10. The electronic cigarette according to claim 9, wherein a sidewall of the second connection portion is provided with a charging interface which is configured for charging electrodes of an external charger to be inserted into.

11. The electronic cigarette according to claim 10, wherein the atomization sleeve and the second connection portion are made from conductive metal and are electrically connected to each other; the first elastic electrode column is electrically connected to the atomization sleeve; a first charging electrode socket and a second charging electrode socket are deposited within the charging interface, the first charging electrode socket is electrically connected to the second connection portion, and the second charging electrode socket is electrically connected to the controller on the control board.

* * * * *